US006666416B1

(12) United States Patent
McAllister

(10) Patent No.: US 6,666,416 B1
(45) Date of Patent: Dec. 23, 2003

(54) BAG HANGING AND STORAGE DEVICE

(75) Inventor: Robert J. McAllister, Solana Beach, CA (US)

(73) Assignee: McAllister Products, Inc., Solana Beach, CA (US)

( * ) Notice: Subject to any disclaimer, the term of this patent is extended or adjusted under 35 U.S.C. 154(b) by 0 days.

(21) Appl. No.: 10/427,240

(22) Filed: Apr. 30, 2003

(51) Int. Cl.[7] ..... B65B 67/04
(52) U.S. Cl. ..... 248/95; 248/99
(58) Field of Search ..... 248/95, 97, 99, 248/100, 130, 145, 145.6, 200.1, 202.1, 316.8, 291.1, 311.2, 907; 383/33, 34; 312/211, 328

(56) References Cited

U.S. PATENT DOCUMENTS 3,374,976 A * 3/1968 Kurlander et al. ..... 248/97
4,062,604 A * 12/1977 Popper ..... 312/211
4,846,427 A * 7/1989 Jones ..... 248/95
4,881,706 A 11/1989 Sedlik
4,998,694 A 3/1991 Barteaux
5,005,791 A 4/1991 Lanzen
5,360,189 A * 11/1994 Hart ..... 248/97
5,503,355 A * 4/1996 Tan ..... 248/101
6,042,063 A * 3/2000 Kerr et al. ..... 248/100
6,152,408 A 11/2000 O'Grady
6,155,521 A * 12/2000 O'Hanlon ..... 248/99
6,330,990 B1 * 12/2001 Haubrich ..... 248/99
6,382,573 B1 * 5/2002 Cepeda ..... 248/97
6,460,814 B1 10/2002 Bolick
6,488,241 B1 12/2002 Kyte et al.
6,598,898 B2 * 7/2003 Chu ..... 280/652

* cited by examiner

*Primary Examiner*—Leslie A. Braun
*Assistant Examiner*—Tan Le
(74) *Attorney, Agent, or Firm*—The Maxham Firm

(57) ABSTRACT

A bag storage and holding apparatus for a recyclable or disposable handle bag. On each end of the receptacle is a rotatably mounted side arm, which can swing up or down through approximately 90 degrees. When the arms are in an approximately horizontal position, the apparatus is positioned for receiving a handle bag and maintaining it in an open position. Securing means, in the form of a locking tab, are provided to secure the side arms in an upward position. Each side arm has handle engaging means for retaining the bag in an open position for receipt of refuse. The apparatus has a receptacle for storing handle bags for future use.

21 Claims, 3 Drawing Sheets

BAG HANGING AND STORAGE DEVICE

BACKGROUND OF THE INVENTION

1. Field of the Invention

The present invention generally relates to bag hanging and storage devices and more particularly to an apparatus for storing and hanging handle bags and the like for receiving refuse.

2. Discussion of the Related Art

There are various devices for holding handle bags open for the purpose of receiving refuse. Some of these devices stand on a flat surface, while others are mounted on a vertical surface. However, one common aspect is that the bag is held open so that refuse can be deposited inside.

Several of the known devices also have hinged or collapsible arms for holding the open bag. These arms may be notched or grooved for placement and holding of the handle. The arms can be folded inward for storage of the device when not in use. This is particularly advantageous where the device is mounted on the inside of a cabinet door, for example.

However, no known device also provides for sufficient storage of bags when not in use. In this regard, the present invention substantially fulfills this need.

SUMMARY OF THE INVENTION

The present invention provides a bag holding and storage apparatus for retaining a recyclable or disposable handle bag, which bag may be of the type referred to as "plastic" in retail stores. It provides a means to store bags when not in use and to conveniently access and position them in an open position for receiving refuse. The apparatus is preferably mounted in a convenient location, for example, on the inside of a cabinet door. When not in use, the arms of the apparatus can be folded down to minimize the space it occupies.

The apparatus has a receptacle shaped and configured to store a plurality of bags. The receptacle has first and second ends and front and back sides. A first side arm member having a top surface is also provided. This member is rotatably connected at the first end of the receptacle and is capable of extending forward from the front side when in a receiving position and extending downward when in a stored position. A second side arm member having a top surface is provided. This member is rotatably connected at the second end of the receptacle and is capable of extending forward from the front side when in a receiving position and extending downward when in a stored position. Securing means are located on the first and second ends of the receptacle for securing the first side arm and the second side arm, respectively, in a receiving position. A bag handle engaging means is on the top surface of each side arm member, each bag handle engaging means being adapted to positively retain the handle of the bag, thereby holding the bag open for receipt of refuse.

In one embodiment, the bag handle engaging means includes a lip that extends upward and slightly away from the center of the apparatus. The lip is formed on a longitudinal axis of the top surface of the side arm members and is configured to engage the handles of the bag and retain the bag in an open position.

In another embodiment, the spaced handle engaging means have notches or grooves in the top edge of each arm members. Two notches in each arm member form a central section therebetween. The notches are particularly adapted to positively retain the handle of the bag when the handle extends partially around the central section when looped from outside inwardly over the central section. The notches may further have semi-spherical bumps or ridges inside to further aid in engaging the bag handle.

In the embodiments disclosed herein, the side arm members are rotatable through approximately 90 degrees so that they are movable between an approximately horizontal position and an approximately vertical position.

In the embodiments disclosed herein, the securing means further has a locking tab means. The locking tab means has a tab and a bulbous body portion that, when in an engaged position, the body portion prevents rotation of the side arm, and when in a disengaged position, it allows rotation of the side arm.

BRIEF DESCRIPTION OF THE DRAWING

The objects, features and advantages of the invention will become more apparent to those skilled in the art after considering the following detailed description, when read in connection with the accompanying drawing, wherein.

DETAILED DESCRIPTION OF THE PREFERRED EMBODIMENTS

Throughout this description, the embodiments and examples shown should be considered as exemplars, rather than as limitations on the present invention. In the following paragraphs, embodiments of the present invention will be described in detail by way of example with reference to the attached drawings.

Figure 1:
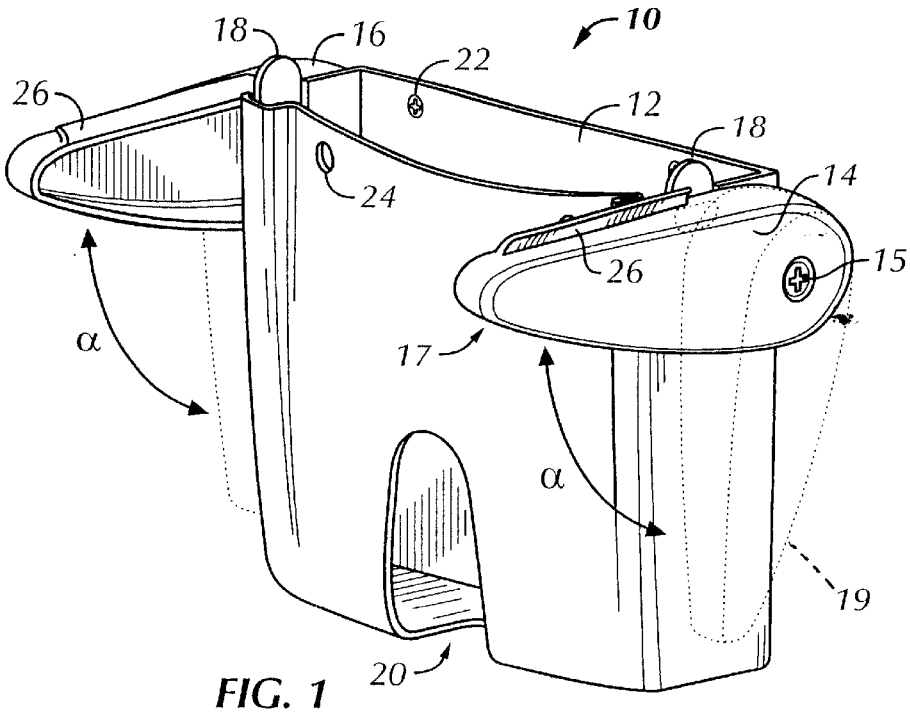
FIG. 1 is perspective view of an embodiment of the invention.
Figure 2:
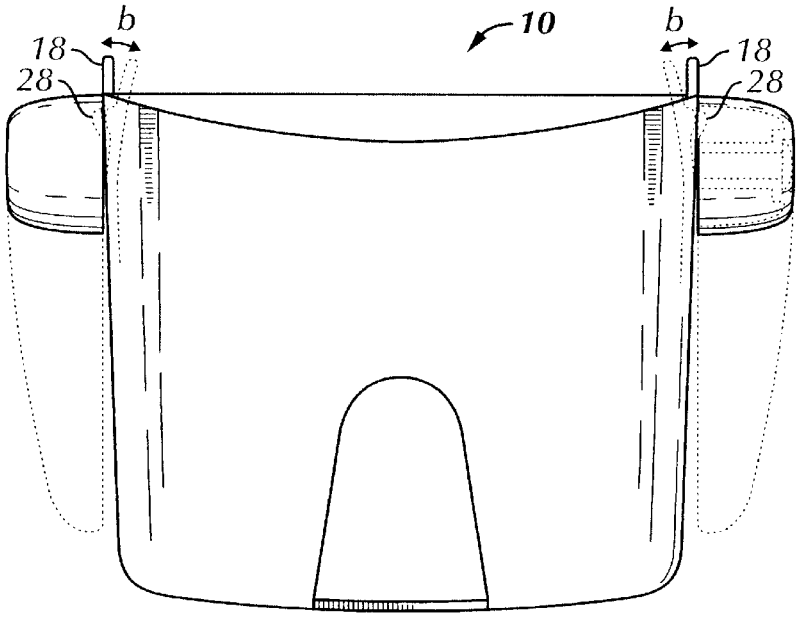
FIG. 2 is a front view of the embodiment shown in FIG. 1.

Referring to FIGS. 1 and 2, a bag storage and hanging device in accordance with one embodiment of the invention is illustrated and designated generally by the numeral 10. The device has receptacle 12 that is generally shaped and configured to store a plurality of bags when they are not in use. Those skilled in the art understand that the size of the receptacle may vary depending on various factors including the overall space to be occupied by the apparatus and also the number of bags to be stored. The receptacle also has means 22 for attachment to a solid support, for example, usually a vertical surface, the inside wall or door of a cabinet. Means 22 can be a screw, or other appropriate form of attachment well known to those skilled in the art. Hole 24 is provided on a front side of the receptacle, thereby allowing a screwdriver, for example, to be used to secure the receptacle to the support. Opening 20, which is near or at the bottom portion of the receptacle, serves as convenient means for access and withdrawal of bags from the receptacle. It is preferable to withdraw the bags from the bottom of the receptacle in this manner since they will be more likely withdrawn one at a time. If a bag is removed from the top of the receptacle, it is quite possible that more than one bag will come out at a time.

Receptacle 10 has a front and back, as well as a first end and a second end. First side arm member 14 is rotatably connected at the first end of the receptacle by pivot connection 15, which may be a bolt or dowel. Other well-known forms of connection are also contemplated herein. Member 14 is capable of extending forwardly from the front side to receiving position 17. It is also capable of extending downwardly to storage position 19 (indicated in dashed lines). The path of rotation of member 14 is indicated by arrow "a" in FIG. 1. Second side arm member 16 is rotatably connected at the second end of the receptacle and operates in a similar manner.

Securing means 18, located on the first and second ends of the receptacle, secures each side arm member in receiving position 17. In the embodiment shown in FIG. 1, the securing means is a locking tab, made up of a tab and a bulbous body portion, which when in an engaged position, prevents rotation of the side arms, and when in a disengaged position allows rotation of the side arm.

As shown in FIG. 2, by pressing securing means 18 away from the side arm, or toward the center of the receptacle, as shown by arrow "b," bulbous body portion 28 is withdrawn from an interior space or detent of the side arm, thereby allowing the side arm to rotate. Means 18 is tensioned so that in a relaxed state it is in an engaged position. Phantom lines adjacent to means 18 in FIG. 2 show the disengaged position of the securing means.

Side arm members 14 and 16 also have bag handle engaging means 26 on their top surfaces. The bag handle engaging means are adapted to positively retain the handle of the bag, thereby holding the bag open for the receipt of refuse. In the embodiment shown in FIG. 1, the bag handle engaging means is formed as raised lip 26 on a longitudinal axis of the top surface of side arm members 14 and 16. The lip extends upward and slightly away from the center of the apparatus, thereby being configured to engage the handles of the bag and retain the bag in an open position.

Figure 3:
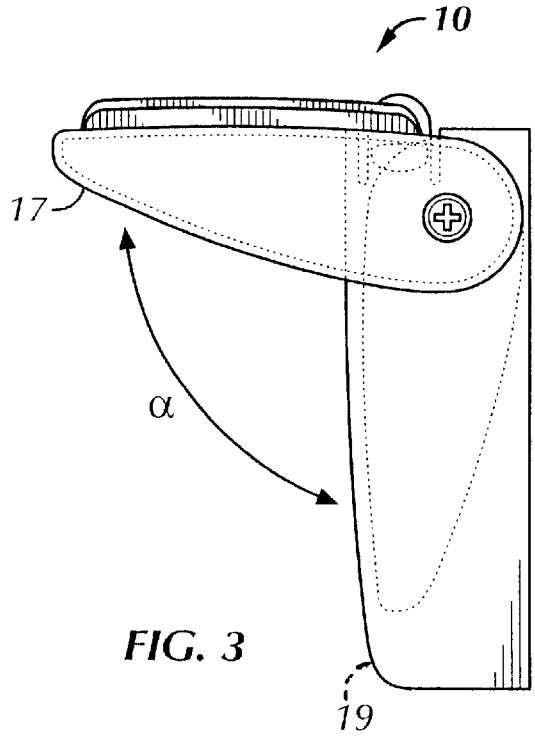
FIG. 3 is an end view of the embodiment shown in FIGS. 1 and 2.

FIG. 3 is an end view of the embodiments shown in FIGS. 1 and 2. Arrow "a" shows the movement of the side arm from engaged position 17 to disengaged position 19. When the side arm is in the disengaged position, it is generally flush with the front surface of the receptacle.

Figure 4:
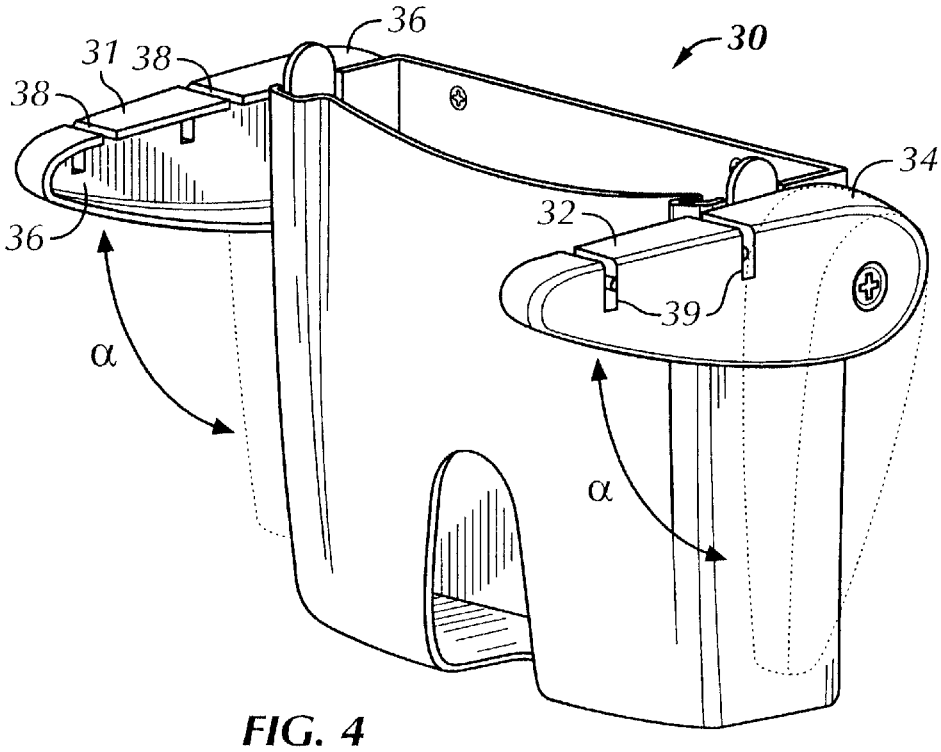
FIG. 4 is a perspective view of an alternate embodiment of the invention.

FIG. 4 is a perspective view of an alternate embodiment 30 of the present invention. Horizontal edges 31 and 32 of side arm members 33 and 34, respectively, have a pair of spaced notch means or grooves 38 and 39, respectively, formed therein in a spaced relationship. Notches 38 and 39 are dimensioned for receiving opposing sides of inverted U-shaped handles, which are disposed on opposing sides of a plastic grocery bag, for example. Thus, the bag is held open when the handle sides are inserted into the notches. In other respects, this embodiment 30 is similar in design and operation to previous embodiments. The spaced notch means form a central section therebetween in each side arm member. The notches are also adapted to positively retain the handle of the bag when the handle extends partially around the central section when looped from outside inwardly over the central section.

Figure 5:
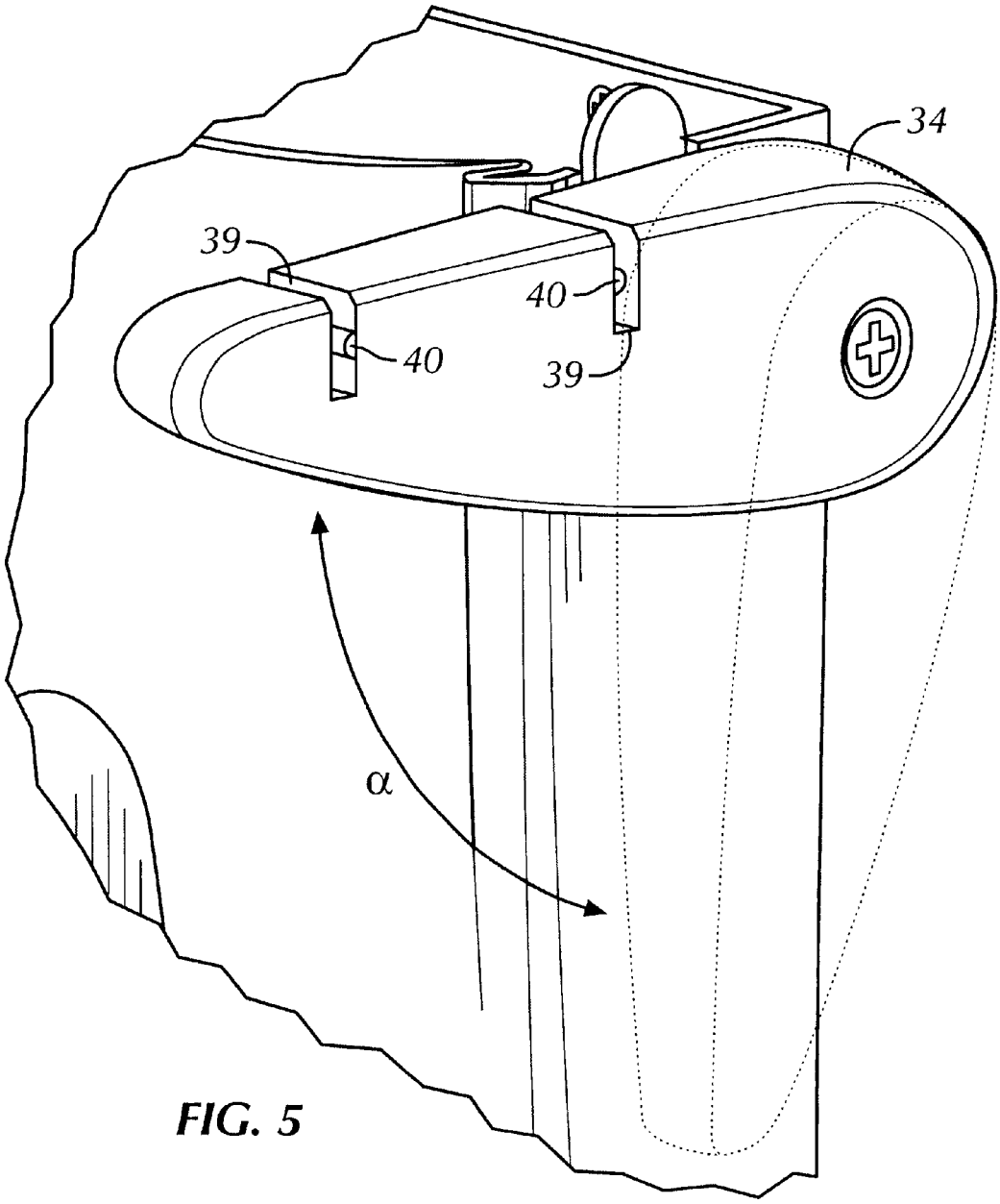
FIG. 5 is a detailed view of the handle securing means of the embodiment shown in FIG. 4.

FIG. 5 is a detailed view of the notches shown in the embodiment of FIG. 4. Formed within notches 39 are irregularities 40 to facilitate positive engagement of the handle. In one embodiment, the irregularities are bumps or semi-spherical ridges. These bumps or ridges may be arranged in an alternating fashion on opposite faces of the notches. Although only one is shown in each notch, there could be more than one ridge or bump, preferably two, in each notch. The ridges or bumps therefore serve to further secure the bag handle within the recesses and to prevent the handle from coming out of the notches unintentionally.

Certain preferred embodiments have been described above. It is to be understood that a latitude of modification and substitution is intended in the foregoing disclosure, and that these modifications and substitutions are within the literal scope, or are equivalent to the claims that follow. Accordingly, the following claims should be construed broadly and in a manner consistent with the intent and scope of the invention herein described.

What is claimed is:

1. A bag holding and storage apparatus for retaining a recyclable or disposable handle bag, said apparatus comprising:

a receptacle shaped and configured to store a plurality of said bags, said receptacle having spaced first and second ends and spaced front and back sides;

a first side arm member having a top surface, said member being rotatably connected at said first end of said receptacle and capable of extending forwardly from said front side when in a receiving position and extending downwardly when in a stored position;

a second side arm member having a top surface, said member being rotatably connected at said second end of said receptacle and capable of extending forwardly from said front side when in a receiving position and extending downwardly when in a stored position; and bag handle engaging means on said top surface of each said side arm member, said bag handle engaging means being adapted to positively retain the handle of the bag in a manner holding the bag open for receipt of refuse.

2. The apparatus recited in claim 1, wherein said receptacle is formed with means for mounting to an external structure.

3. The apparatus recited in claim 1, wherein said receptacle is formed with an opening for removing individual said bags therefrom.

4. The apparatus recited in claim 1, wherein said handle engaging means comprises a plurality of spaced notches in said top edge of said side arm members.

5. The apparatus recited in claim 4, wherein said notches further comprise semi-spherical bumps or ridges inside said notches to further aid in positively engaging said handle.

6. The apparatus recited in claim 1, wherein said side arm members are rotatable through approximately 90 degrees.

7. The apparatus recited in claim 5, wherein said side arm members are rotatable between an approximately horizontal position and an approximately vertical position.

8. The apparatus recited in claim 1, wherein said handle engaging means comprise a raised lip formed on a longitudinal axis of the top surface of each said first and second side arm members, said lip extending upward and slightly away from the center of the apparatus and being configured to engage the handles of the bag and retain the bag in an open position.

9. The apparatus recited in claim 1, further comprising securing means located on said first and second ends of said receptacle for securing said first side arm and said second side arm, respectively, in a receiving position.

10. The apparatus recited in claim 9, wherein the securing means further comprises a locking tab means.

11. The apparatus recited in claim 10, wherein the locking tab means comprises a tab and a bulbous body portion that, when in an engaged position, prevents rotation of the side arm, and when in an disengaged position, allows rotation of the side arm.

12. A bag holding and storage apparatus for retaining a recyclable or disposable handle bag, said apparatus comprising:

a receptacle shaped and configured to store a plurality of said bags, said receptacle having first and second ends and front and back sides, said receptacle being formed with means for mounting said back side to external structure;

a first side arm member having a top surface, said member being rotatably connected at said first end of said receptacle and capable of extending forwardly from said front side when in a receiving position and extending downwardly when in a stored position;

a second side arm member having a top surface, said member being rotatably connected at said second end of said receptacle and capable of extending forwardly from said front side when in a receiving position and extending downwardly when in a stored position;

locking means located on said first and second ends of said receptacle for locking said first side arm and said second side arm, respectively, in a receiving position;

spaced handle engaging means in said top surface of each said side arm member forming a central section therebetween, said engaging means being adapted to positively retain the handle of the bag which handle extends partially around said central section when looped from outside inwardly over said central section, the bag thereby being positively retained open for receipt of refuse.

13. The apparatus recited in claim 12, wherein said spaced handle engaging means further comprise notches.

14. The apparatus recited in claim 13, wherein said notches further comprise semi-spherical bumps or ridges inside said notches to further aid in positively engaging said handle.

15. The apparatus recited in claim 12, wherein said side arm members are rotatable through approximately 90 degrees.

16. The apparatus recited in claim 15, wherein said side arm members are rotatable between an approximately horizontal position and an approximately vertical position.

17. The apparatus recited in claim 12, wherein the locking means further comprises a locking tab means.

18. The apparatus recited in claim 17, wherein the locking tab means comprises a tab and a bulbous body portion that, when in an engaged position, prevents rotation of the side arm, and when in an disengaged position, allows rotation of the side arm.

19. A bag holding and storage apparatus for retaining a recyclable or disposable handle bag, said apparatus comprising:

a receptacle shaped and configured to store a plurality of said bags, said receptacle having spaced first and second ends and spaced front and back sides;

a first side arm member pivotably connected at said first end of said receptacle and selectively movable between a receiving position projecting outwardly from said receptacle and a stored position generally parallel with said first end;

a second side arm member pivotably connected at said second end of said receptacle and selectively movable between a receiving position projecting outwardly from said receptacle and a stored position generally parallel with said second end; and bag handle engaging means on said top surface of said first and second side arm members, said bag handle engaging means being adapted to positively retain the handle of the bag in a manner holding the bag open for receipt of refuse.

20. The apparatus recited in claim 19, further comprising securing means located on said first and second ends of said receptacle for securing said first side arm and said second side arm, respectively, in a receiving position.

21. The apparatus recited in claim 20, wherein the securing means further comprises a locking tab means comprising a tab and a bulbous body portion that, when in an engaged position, prevents rotation of the side arm, and when in an disengaged position, allows rotation of the side arm.

* * * * *